US008267008B2

(12) United States Patent
Yasuhara

(10) Patent No.: US 8,267,008 B2
(45) Date of Patent: Sep. 18, 2012

(54) HEATING UNEVENNESS PREVENTING DEVICE FOR STEAM OVEN FOR AIRCRAFT

(75) Inventor: Koji Yasuhara, Tokyo (JP)

(73) Assignee: Jamco Corporation, Tokyo (JP)

( * ) Notice: Subject to any disclaimer, the term of this patent is extended or adjusted under 35 U.S.C. 154(b) by 411 days.

(21) Appl. No.: 12/711,590

(22) Filed: Feb. 24, 2010

(65) Prior Publication Data

US 2010/0224083 A1 Sep. 9, 2010

(30) Foreign Application Priority Data

Mar. 9, 2009 (JP) ..... 2009-054790

(51) Int. Cl.
*A23L 1/00* (2006.01)

(52) U.S. Cl. ..... 99/467; 99/473; 99/474; 99/476; 99/448

(58) Field of Classification Search ..... 99/467, 99/473, 474, 476, 448
See application file for complete search history.

(56) References Cited

U.S. PATENT DOCUMENTS 5,203,258 A * 4/1993 Tippmann et al. ..... 99/483
5,209,941 A * 5/1993 Wuest ..... 426/510
6,318,246 B2 * 11/2001 Fukushima et al. ..... 99/330
7,045,745 B2 * 5/2006 Kim ..... 219/400
8,132,500 B2 * 3/2012 Linskens et al. ..... 99/473
2006/0070532 A1 * 4/2006 Chang ..... 99/476
2006/0207440 A1 * 9/2006 Matsuo et al. ..... 99/467
2008/0237213 A1 10/2008 Bujeau et al.

FOREIGN PATENT DOCUMENTS

DE 8717935 U1 6/1991
JP 2003-227612 A 8/2003
JP 2003-314826 A 11/2003

OTHER PUBLICATIONS

European Office Action dated Mar. 7, 2011, issued in corresponding European Patent Application No. 10405036.4.
European Search Report dated Jul. 29, 2010, issued in corresponding European Patent Application No. 10405036.4.

* cited by examiner

*Primary Examiner* — Benjamin Layno
(74) *Attorney, Agent, or Firm* — Westerman, Hattori, Daniels and Adrian, LLP

(57) ABSTRACT

The centrifugal fan for circulating a steam in the cook chamber of a steam oven is rotated in the reverse direction only for a certain time of a set cooking time, whereby a steam circulating flow generated in the cook chamber is changed, and consequently, the foods on the casseroles placed in the cook chamber are uniformly heated.

2 Claims, 5 Drawing Sheets

HEATING UNEVENNESS PREVENTING DEVICE FOR STEAM OVEN FOR AIRCRAFT

The present application is based on and claims priority of Japanese patent application No. 2009-054790 filed on Mar. 9, 2009, the entire contents of which are hereby incorporated by reference.

BACKGROUND OF THE INVENTION

1. Field of the Invention

The present invention relates to steam ovens. More specifically, the present invention relates to a steam oven for an aircraft used for heating and humidifying an in-flight meal to provide the in-flight meal.

2. Description of the Related Art

In such a type of steam oven, water dropped in a cook chamber is heated by an oven heater to generate steam, and, thus, to diffuse the steam in the cook chamber by a centrifugal fan, and, at the same time, generate a circulating flow, whereby food on a casserole placed in the cook chamber is heated and humidified.

Such a steam oven is designed to have a rectangular solid shape in consideration of ease of mounting on an aircraft. A food tray on which a casserole is placed can be freely inserted in and removed from the cook chamber through a door provided on the front surface of the rectangular solid cook chamber.

A plurality of food trays (for example, eight trays) are stacked in a portable rack, and about three to four casseroles can be placed on each food tray according to the size of the casseroles. The food tray is designed so that to provide in-flight service, a plurality of foods can be heated and humidified at one time.

Such a type of steam oven is disclosed in U.S. Pat. No. 5,209,941 and Japanese Patent Application Laid-Open No. 2003-227612.

In a steam oven for an aircraft used for heating in-flight meals, steam is diffused, and a centrifugal fan for generating a steam flow is rotated in the reverse direction for a certain time of a cooking period. Consequently, foods on casseroles on food trays in a rectangular solid cook chamber can be uniformly heated, and thus the occurrence of heating unevenness can be reliably prevented.

As described above, in the steam oven, a plurality of food trays on which casseroles are placed are placed in the rectangular solid cook chamber, and since the centrifugal fan rotating in the normal rotation direction rotates the steam flow, generated in the cook chamber, in the same direction, the steam flow is applied to only a part of the surface of food on each casserole. Thus, it is difficult to uniformly apply the steam to the entire surface of the food.

Further, the steam inevitably stays in the corners of the rectangular solid cook chamber. Each food tray and each casserole, on the upstream side of the steam flow, placed on the food tray are impinged on the steam flow rotating in the same direction to prevent the circulation of the steam flow. Consequently, the steam is not circulated around the casseroles on the downstream side, whereby some foods on the casseroles are not satisfactorily heated, and therefore, passengers may make complaints.

The present invention provides a steam oven for an aircraft, which can realize prevention of occurrence of heating unevenness. A centrifugal fan for generating a steam flow is rotated in the reverse direction for a certain time of a cooking period, whereby the stem flow in the cook chamber is significantly changed to be applied to the surface of each food that is less likely to receive the steam, and, at the same time, by virtue of the reverse rotation of the steam flow, the steam is forcibly circulated around steam staying portions generated in the corners of a rectangular solid cook chamber, racks, and food trays, whereby foods on casseroles placed near the steam staying portions can be uniformly heated.

SUMMARY OF THE INVENTION

According to a first embodiment of the present invention, a steam oven for an aircraft used for heating in-flight meals, in which water dropped from a water supply nozzle is evaporated by an oven heater disposed at the outer periphery of a centrifugal fan, the generated steam is circulated in a cook chamber by the centrifugal fan while being rotated forward unidirectionally, and each food on a plurality of casseroles placed in the cook chamber is heated for a predetermined cooking time, includes rotating the centrifugal fan in the reverse direction only for a certain time of the cooking time to change a steam circulating flow generated in the cook chamber, and, thus, to uniformly heat each food on the casseroles.

According to a second embodiment of the present invention, a centrifugal fan for steam generation is rotated in the reverse direction for a certain time immediately before termination of a predetermined cooking time.

According to the first embodiment of the present invention, the centrifugal fan is rotated in the reverse direction for a certain time of a cooking time, whereby a steam circulating flow generated in a cook chamber is changed to apply the steam to a part of food on a casserole that has not been satisfactorily subjected to the steam flow and to satisfactorily circulate the steam around steam staying portions generated in the cook chamber, and consequently, the unevenness of heating/humidification of food can be reliably prevented.

According to the second embodiment of the present invention, the centrifugal fan is rotated in the reverse direction for a certain time immediately before termination of a predetermined cooking time, whereby in the period immediately before the termination of the predetermined cooking time, whereby the unevenness of heating food can be efficiently prevented in a required minimum reverse rotation period.

DETAILED DESCRIPTION OF THE EMBODIMENTS (Overall Configuration of Steam Oven)

Figure 1:
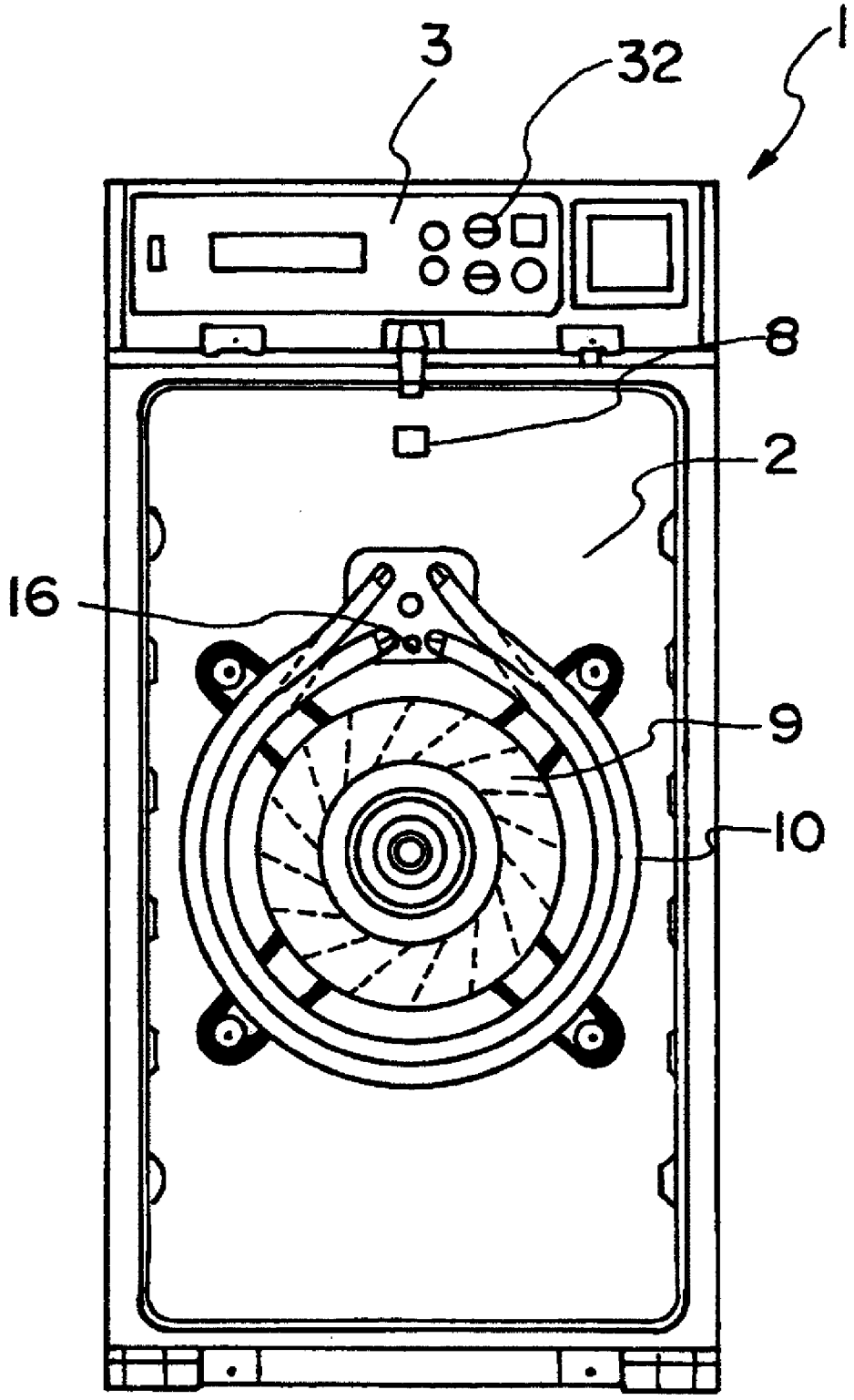
FIG. 1 is a view illustrating a steam generator according to an aspect of the present invention.
Figure 2:
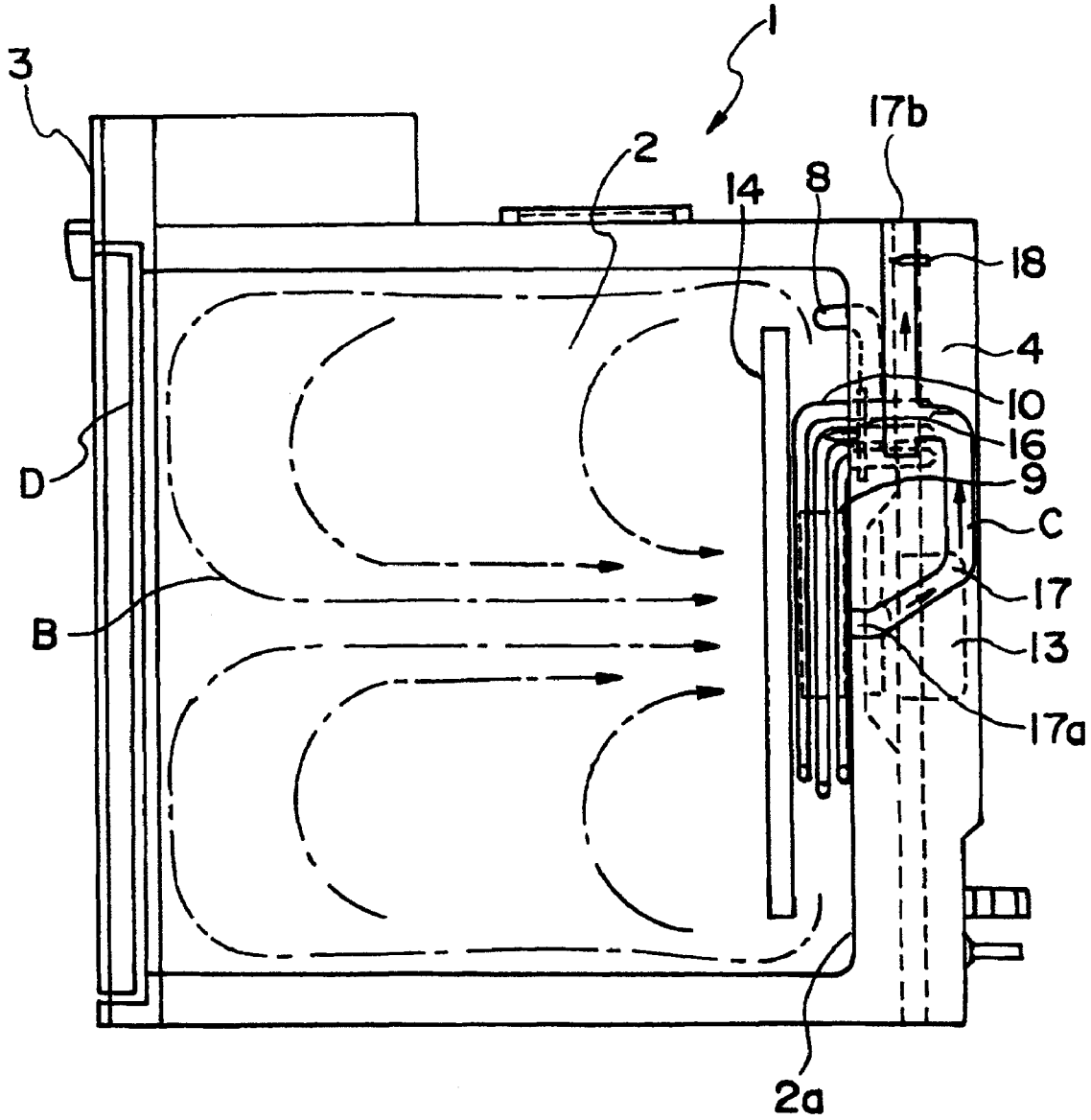
FIG. 2 is a cross-sectional view of a steam oven.

As illustrated in FIGS. 1 and 2, a steam oven 1 according to an aspect of the present invention includes a cook chamber 2 in which foods such as in-flight meals are arranged and a control operation part 3 provided above the cook chamber 2.

The cook chamber 2 has on its back surface an accommodation box 4 for accommodating devices required for cooking food, and especially for heating and humidifying the food. Those devices in the accommodation box 4 are controlled by an electronic controller 31 in the control operation part 3.

The control operation part 3 has on its front surface a large number of switches 32 and so on required for a crewman to operate the steam oven 1. The crewman sets an optimum temperature and cooking period according to the kind and amount of food to be heated and cooked and can heat and cook the food to be provided to passengers.

Figure 3:
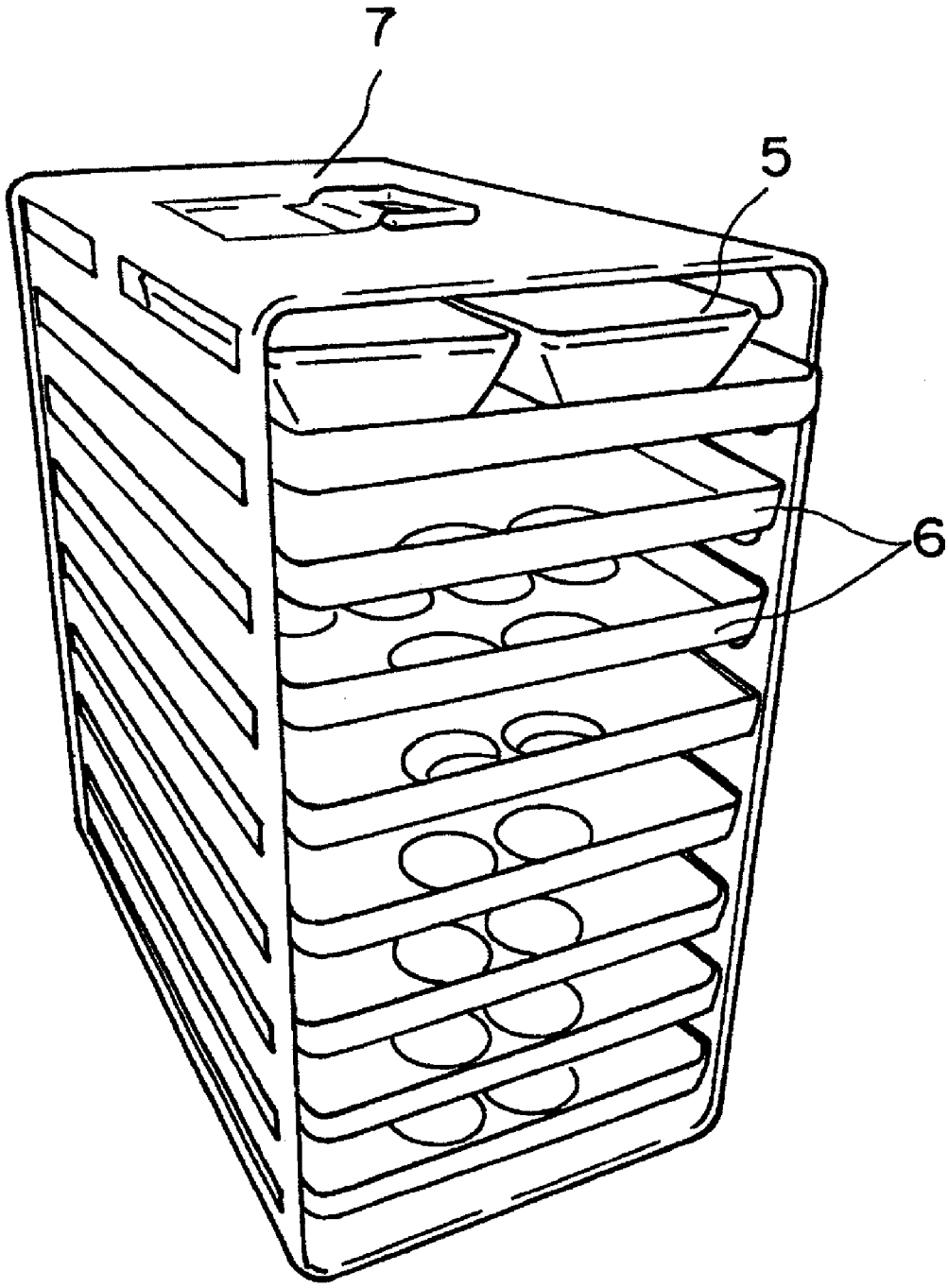
FIG. 3 is a view illustrating a rack used in the steam oven.
Figure 4:
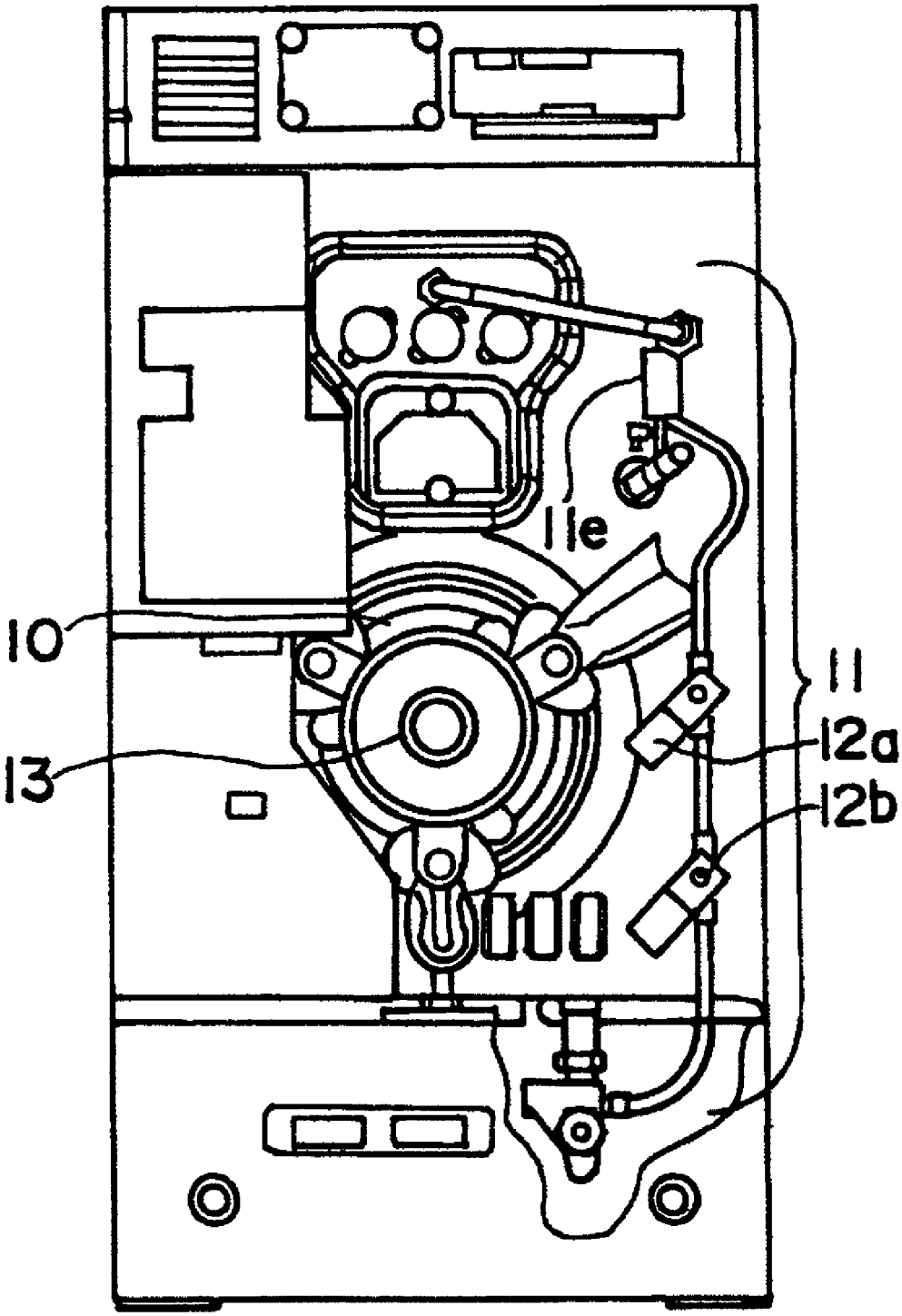
FIG. 4 is a rear view of the steam generator.

As illustrated in FIG. 3, a plurality of casseroles 5 (in this embodiment, four casseroles) are set on a food tray 6 having a plurality of holes. The food trays 6 (in this embodiment, eight trays) are stored in a rack 7, and the rack 7 is set in the cook chamber 2 through a door D provided on the front surface of the cook chamber 2. The rack 7 can be freely inserted in and removed from the cook chamber 2.

In this embodiment, 4×8=32 casseroles are set in the rack 7 and can be heated and humidified at one time.

Each component will now be described in more detail with reference to mainly FIGS. 1, 2, 4, and 5.

A steam generator for generating steam in the steam oven 1 is constituted of a water supply nozzle 8, a fun 9, an oven heater 10, and so on.

The water supply nozzle 8 is provided so as to protrude into the cook chamber 2 through the rear inner wall 2*a* of the cook chamber 2. The water supply nozzle 8 guides water into the cook chamber 2 from the outside of the cook chamber 2, and although it penetrates through the cook chamber 2, the inside and outside (back surface) of the cook chamber 2 are airtightly separated at the boundary of the cook chamber 2.

Figure 5:
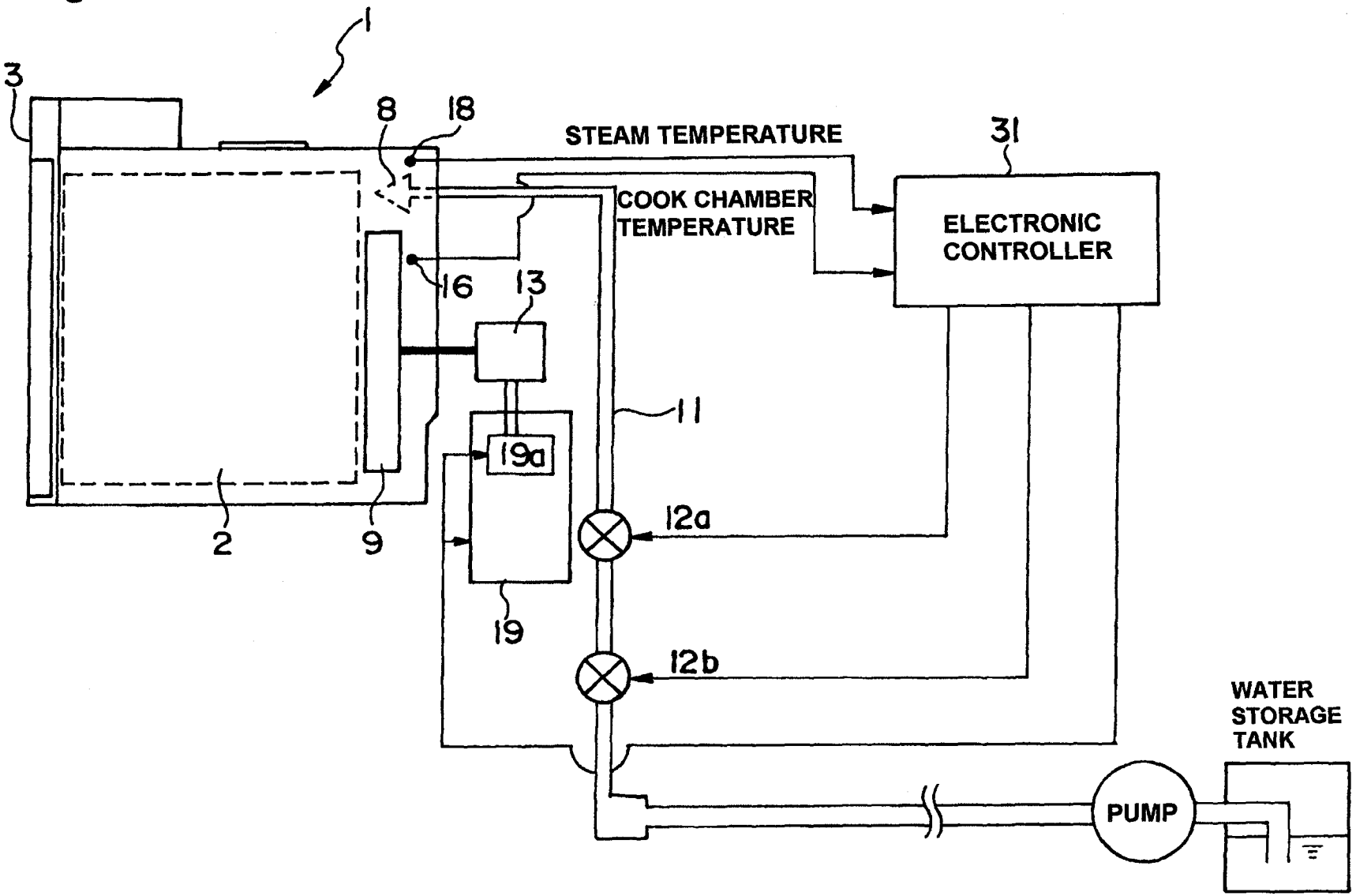
FIG. 5 is a block diagram according to an aspect of the present invention.

The rear end of the water supply nozzle 8, as illustrated in FIG. 5, sucks water from a water storage tank, provided in an aircraft body, through a water supply pipe 11 with a diameter of approximately 2.5 ϕ extending in the vertical direction and is connected to a pump for pressure-feeding water. The pressurized water is jetted in the cook chamber 2 from a water supply inlet provided at the front end of the water supply nozzle 8.

The water supply inlet is located at the upper portion of the cook chamber 2, and especially above the oven heater 10. The amount of water to be supplied is controlled by regulating valves 12*a* and 12*b* provided in the water supply pipe 11.

A dropping part is provided so as to approach the water supply inlet of the water supply nozzle 8 and extend downward at substantially right angles to the water supply inlet. The water jetted from the water supply inlet is impinged on the dropping part to be led downward, and, thus, to be dropped in the cook chamber 2 from the front end.

The three delta-connected oven heaters 10 are provided so as to be somewhat separated from the rear inner wall 2*a* of the cook chamber 2. The oven heaters 10 heat the inside of the cook chamber 2, and, at the same time, change the water, dropped from the dropping part to the oven heaters 10, to steam.

Those oven heaters 10 have such a shape that the water dropped from the dropping part passes through a gap of the end of the oven heater 10 to drop on the lowermost side of the oven heaters 10 or adjacent thereto.

Each end of the oven heaters 10 is connected to an electrical supply source (not shown) provided outside the cook chamber 2 (provided on the back surface of the cook chamber 2) and is provided so as to penetrate through the cook chamber 2. However, since the inside and outside (the back surface) of the cook chamber 2 is airtightly separated at the boundary of the cook chamber 2, the steam in the cook chamber 2 never leaks through the ends of the oven heaters 10.

The annular fan 9 is of a centrifugal type and is provided at substantially the center of the cook chamber 2 so as to be surrounded by the oven heaters 10. The fan 9 is firmly fixed by a nut at the center. The fan 9 is driven by a motor 13 provided outside the cook chamber 2 (provided on the back surface of the cook chamber 2) through a motor shaft penetrating through the cook chamber 2.

Although the motor shaft of the motor 13 is provided so as to penetrate through the cook chamber 2, the inside and outside (the back surface) of the cook chamber 2 are airtightly separated at the boundary of the cook chamber 2.

The fan 9 is driven and rotated by the operation of the motor during a cooking period set by a crewman. The air taken from near the center of the fan 9 is jetted around the fan 9 by the action of a large number of blades arranged on the outer periphery of the fan 9. Consequently, heat and steam from the oven heaters 10 disposed so as to surround the fan 9 are diffused in the cook chamber 2.

As illustrated in FIG. 2, the entire front surface of the fan 9 is covered by a baffle plate 14, but air can be taken through a plurality of air intake ports (not shown) provided at the center of the baffle plate 14.

Meanwhile, the air jetted by the fan 9 is blocked by the baffle plate 14, and therefore, as shown in dashed arrows B in FIG. 2, the air is jetted into the cook chamber 2 through a gap between the baffle plate 14 and the upper, lower, left and right inner walls of the cook chamber 2. The air in the cook chamber 2 is stirred by the action of the fan 9, and hot air containing steam that is a steam flow is generated in the cook chamber 2 in the rotating direction of the fan 9 to heat and humidify foods on the casseroles 7 placed on the food trays 6.

A cook chamber temperature sensor 16 is provided in a space between the ends of the oven heater 10 so as to protrude from the rear inner wall 2*a*. The cook chamber temperature sensor 16 is located at the position where the heat and steam generated by the fan 9 always pass through the cook chamber temperature sensor 16.

An entrance 17*a* of a steam path 17 is provided between the oven heater 10 and the fan 9 so as to be opened to the inside of the cook chamber 2. As shown in arrows C in FIG. 2, the steam generated in the cook chamber 2 enters the entrance 17*a* to pass through the steam path 17 extending somewhat obliquely upward and, thus, to be discharged to the outside of the steam oven 1.

The entrance 17*a* and the steam path 17 are always opened, and the inside of the cook chamber 2 and the outside of the steam oven 1 are always communicated with each other. Thus, the cook chamber 2 is always opened to the outside air.

A steam temperature sensor 18 is provided near a steam outlet 17*b* of the steam path 17. The steam temperature sensor 18 measures the temperature of the steam discharged from the steam outlet 17*b*, and a detected value detected by the steam temperature sensor 18 is transmitted to the electronic controller 31 of the control operation part 3 along with a detected value from the cook chamber temperature sensor 16. The electronic controller 31 responses to those detected values to adjust a drive signal for driving the regulating valves 12*a* and 12*b*, that is, the frequency of the opening operation, and, thus, to regulate the amount of water to be supplied through the water supply nozzle 8 and dropped in the cook chamber 2.

The steam temperature sensor 18 is not necessarily provided near the steam outlet 17*b* and may be provided at the middle of the steam path 17 and so on. However, the discharged steam becomes most stable near the steam outlet 17*b*, and therefore, in order to accurately measure the steam temperature, the steam temperature is preferably measured near the steam outlet 17*b*.

For example, when the temperature in the cook chamber 2 is abnormally high, the control operation part 3 can generate an alarm to crewmen, or the steam oven 1 can be automatically turned off by a thermostat.

FIRST EXAMPLE

First and Second Embodiments

As illustrated in FIG. 5, the fan 9 is rotated and controlled by the motor 13 controlled by a motor drive circuit 19, and a well-known inverter fan is preferably used so that the rotation number can be freely adjusted.

The motor drive circuit 19 has a well-known forward/reverse switching circuit 19*a* so that the rotation of the motor 13 can be switched between the forward rotation and the reverse rotation. The forward/reverse switching circuit 19*a* is operated by the instruction from the electronic controller 31.

In order to heat a predetermined number of casseroles 5, when a crewmen stores the casseroles 5 on the food trays 6 in the cook chamber 2 to operate the switches 32 of the control operation part 3, and, thus, to set the cooking period of, for example, 22 minutes, the electronic controller 31 issues an instruction to the regulating valves 12*a* and 12*b* based on the instruction to supply a suitable amount of steam, and, at the same time, to start control of the motor 13 for driving the fan 9 through the motor drive circuit 19.

At that time, the electronic controller 31 rotates the fan 9 in the forward direction for 20 minutes from the start of cooking with a built-in timer. As described above, the air in the cook chamber 2 is stirred, and the hot air containing steam that is the steam flow in the forward rotation direction of the fan 9 circulates in the cook chamber 2 to heat and humidify the foods on the casseroles 5 placed on the food trays 6.

After a lapse of 20 minutes of the cooking period, in the last two minutes, the forward/reverse switching circuit 19*a* of the motor drive circuit 19 is operated, and control is sequentially performed so that the fan 9 is rotated in the reverse direction for the two minutes.

According to the constitution, the rotation direction of the fan 9 which has rotated in the forward direction is changed to the reverse direction at one time, whereby a large disturbed flow of the steam flow is generated in each part in the cook chamber 2. Thereafter, since the steam flow rotates in the reverse direction, the steam flow is applied to a part of the surface of food on the casserole 5 that has not been directly subjected to the steam flow and a part where the steam flow is inhibited by the food trays 6, the rack 7, and the side surfaces of the casseroles 5. Further, a high temperature steam flow in the final stage of the cooking period is introduced into the corners of the rectangular solid cook chamber 2, whereby some foods that are not satisfactorily heated can be heated to a predetermined temperature at one time.

According to this embodiment, just by providing the forward/reverse switching circuit 19*a* in the motor drive circuit 19 and changing a program of the electronic controller 31, the heating unevenness in a steam oven can be prevented without significantly increasing cost.

The present inventors have performed various experiments and prototyped. Four casseroles 5 with foods to be generally provided as in-flight meals are each placed on eight food trays 6 to be stored in the cook chamber 2, and, thus, to be cooked for 22 minutes. In that case, the steam flow is rotated in the reverse direction in the last two minutes immediately before the termination of the cooking time, whereby the temperature difference between foods, that is, the temperature difference between the maximum temperature and the minimum temperature of the foods on the casseroles 5 in the cook chamber 2 can be reduced to 12.3° C.

When the steam flow is rotated in the forward direction for 22 minutes as in the prior arts, the temperature difference is increased to 18.5° C. In both cases, there is no significant difference in the maximum temperature.

In the embodiment, the steam flow is rotated in the reverse direction only for the last two minutes of the cooking time of 22 minutes set by a crewman. However, when the steam flow is rotated in the reverse direction, the steam in the cook chamber 2 is discharged through an air intake port so as to flow in the reverse direction, and therefore, if the steam flow is rotated in the reverse direction for a too long period of time, the temperature in the cook chamber 2 is reduced, whereby food cannot be heated to a desired temperature.

The steam flow is rotated in the reverse direction for the last two minutes of the cooking time of 22 minutes because the steam in the cook chamber has the highest temperature in the final stage of the cooking time, whereby the heating unevenness can be eliminated by brief rotation in the reverse direction. If the steam in the cook chamber is heated to the highest temperature, the steam flow may be rotated in the reverse direction at a timing other than the final stage of the cooking time.

The present invention is applied to a steam oven for an aircraft, whereby even when a large number of foods on casseroles are heated at one time, they can be uniformly heated.

In that case, just by providing the well-known forward/reverse switching circuit 19*a* and changing a program of the electronic controller 31, the present invention can be applied without significantly increasing cost, and thus the added value of the steam oven can be significantly increased.

What is claimed is:

1. A steam oven for an aircraft used for heating in-flight meals, comprising:

a centrifugal fan;

an oven heater disposed at an outer periphery of the centrifugal fan;

a cook chamber; and a plurality of casseroles disposed in the cook chamber, wherein water dropped from a water supply nozzle is evaporated by the oven heater, thereby generating steam;

the steam is circulated in the cook chamber by the centrifugal fan while being rotated forward unidirectionally;

each food on the casseroles is heated for a predetermined cooking time; and a steam circulating flow generated in the cook chamber is changed by rotating the centrifugal fan in the reverse direction only for a certain time of the cooking time to uniformly heat each food on the casseroles.

2. The steam oven according to claim 1, wherein the centrifugal fan is rotated in the reverse direction only for the certain time immediately before termination of the predetermined cooking time.

* * * * *